US008459943B2

(12) United States Patent
Schutte et al.

(10) Patent No.: US 8,459,943 B2
(45) Date of Patent: Jun. 11, 2013

(54) GAS TURBINE ENGINE ROTOR SECTIONS HELD TOGETHER BY TIE SHAFT, AND WITH BLADE RIM UNDERCUT

(75) Inventors: Peter Schutte, San Diego, CA (US); Daniel Benjamin, Simsbury, CT (US); Roland R. Barnes, Bloomfield, CT (US)

(73) Assignee: United Technologies Corporation, Hartford, CT (US)

( * ) Notice: Subject to any disclaimer, the term of this patent is extended or adjusted under 35 U.S.C. 154(b) by 606 days.

(21) Appl. No.: 12/720,771

(22) Filed: Mar. 10, 2010

(65) Prior Publication Data

US 2011/0223025 A1 Sep. 15, 2011

(51) Int. Cl.
*F01D 5/06* (2006.01)

(52) U.S. Cl.
USPC ..... 415/199.4; 416/193 A; 416/198 A

(58) Field of Classification Search
USPC ..... 415/199.5, 199.4; 416/198 A, 198 R, 416/193 A, 234
See application file for complete search history.

(56) References Cited

U.S. PATENT DOCUMENTS 2,452,782 A * 11/1948 McLeod et al. ..... 416/201 R
3,528,241 A 9/1970 Venable et al.
3,575,528 A * 4/1971 Beam et al. ..... 416/39
3,610,777 A * 10/1971 Wagle ..... 416/198 R
3,823,553 A 7/1974 Smith
3,976,399 A 8/1976 Schmoch
4,057,371 A 11/1977 Pilarczyk
4,123,199 A 10/1978 Shimizu et al.
4,247,256 A 1/1981 Maghon
4,611,464 A 9/1986 Hetzer et al.
4,915,589 A 4/1990 Gessler et al.
4,934,140 A 6/1990 Dennison et al.
4,944,660 A 7/1990 Joco
5,220,784 A 6/1993 Wilcox
5,537,814 A 7/1996 Nastuk et al.
5,558,496 A * 9/1996 Woodmansee et al. ..... 416/95
5,653,581 A 8/1997 Dixon et al.
5,988,980 A * 11/1999 Busbey et al. ..... 416/193 R
6,231,301 B1 5/2001 Barnett et al.
6,267,553 B1 * 7/2001 Burge ..... 415/115
6,312,221 B1 11/2001 Yetka et al.
6,619,909 B2 9/2003 Barnett et al.
6,672,630 B2 1/2004 Pinzauti et al.
6,761,536 B1 * 7/2004 Bash et al. ..... 416/193 A
7,186,079 B2 * 3/2007 Suciu et al. ..... 415/199.5
2009/0016886 A1 * 1/2009 Pichel ..... 416/198 A

* cited by examiner

*Primary Examiner* — Edward Look
*Assistant Examiner* — Liam McDowell
(74) *Attorney, Agent, or Firm* — Carlson, Gaskey & Olds, PC

(57) ABSTRACT

An integrally bladed rotor is utilized in at least a stage of one of a compressor and turbine section. Airfoils extend radially outwardly from a platform, and there is an undercut inward from the platform at a downstream edge of the airfoil.

6 Claims, 2 Drawing Sheets

GAS TURBINE ENGINE ROTOR SECTIONS HELD TOGETHER BY TIE SHAFT, AND WITH BLADE RIM UNDERCUT

BACKGROUND OF THE INVENTION

This application relates to an undercut rim used with a bladed rotor disk for a gas turbine engine section, wherein a plurality of rotor sections are held together by a tie shaft.

Gas turbine engines are known, and typically include a compressor section that compresses air to be delivered into a combustion section. Air is mixed with fuel in the combustion section and ignited. Products of this combustion pass downstream over turbine rotors, driving the turbine rotors to rotate.

Typically, the turbine rotors are arranged in several stages as are compressor rotors. It has typically been true that the rotor stages have been connected together by welded joints, bolted flanges, or other mechanical fasteners. This has required a good deal of additional weight and components.

More recently, a tie shaft arrangement has been proposed wherein the rotors all abut each other, and a tie shaft applies an axial force to hold them together and transmit torque, thus eliminating the need for weld joints, bolts, etc.

Some integrally bladed rotors have the abutment face in the proximity of the airfoil edge that will expose the airfoil to stresses generated by tie shaft preload and rotational forces.

SUMMARY OF THE INVENTION

An integrally bladed rotor is utilized in at least a stage of one of a compressor and turbine section. The rotors feature and inner hub and an outer rim that includes the platform the airflow path (platform). Airfoils extend radially outwardly from a platform, and there is an undercut in the rotor rim under the platform between the airfoil and the abutting face at a downstream edge of the airfoil.

These and other features of the present invention can be best understood from the following specification and drawings, the following of which is a brief description.

DETAILED DESCRIPTION OF THE PREFERRED EMBODIMENT

Figure 1:
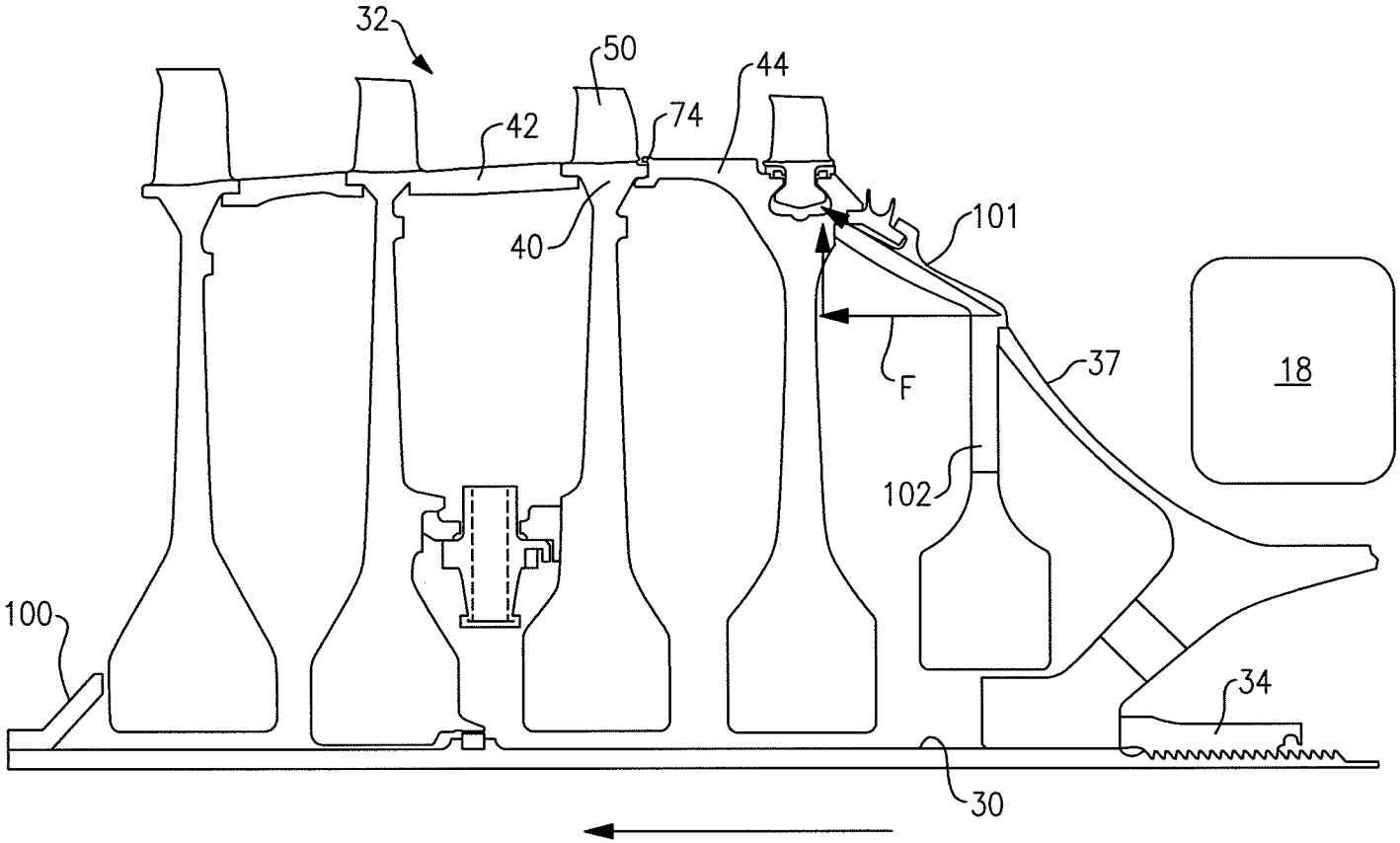
FIG. 1 schematically shows a typical compressor section.

FIG. 1 shows a compressor rotor 32 that utilizes a tie shaft connection. As known, a tie shaft 30 joins together a compressor section 32, comprising of a plurality of rotor stages 40, 42, and 44. The sections 40, 42 and 44 may all be "integrally bladed rotors," or may have removable blades. As illustrated, rotor 44 has removable blades, as an example. Rotor stage 40 is an integrally bladed rotor, with a rotor hub that rotates about an axis of the shaft 30, and which carries a plurality of secured rotor blades 50.

As can be appreciated, an upstream end of the rotor 44 provides the stacking interface with a downstream end of the integrally bladed rotor 40. Typically, these interfaces have been simply placed radially inward of the platform of the integrally bladed rotor, and abutting an end face of the neighboring rotor. As mentioned above, with such an arrangement, there has been a force or stress applied forcing the platform of the integrally bladed rotor radially outwardly.

As shown, a rear hub 37 biases the stages together. At the left, or upstream side of a front hub 100, shown schematically, provides the reaction for the rotors stack being compressed by the tie shaft 30. In practice, there may be something closer to the rear hub 37 extending radially away from the tie shaft 30 at the left side in place of the schematically shown hub 100. A nut 34 directs a force through the hub 37 into the several stages, holding them together. A force vector along the axis of a portion 101 of a section 102, directs the force into the rotor stages.

Figure 3:
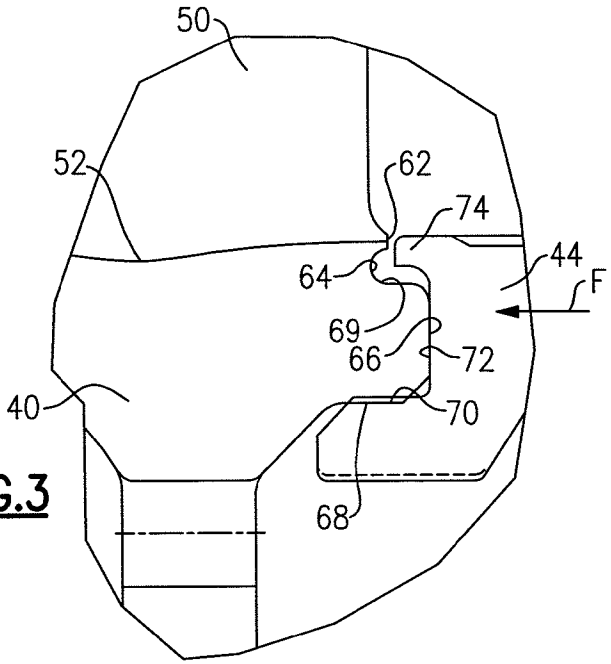
FIG. 3 shows an enlarged portion of the FIG. 2 section.
Figure 2:
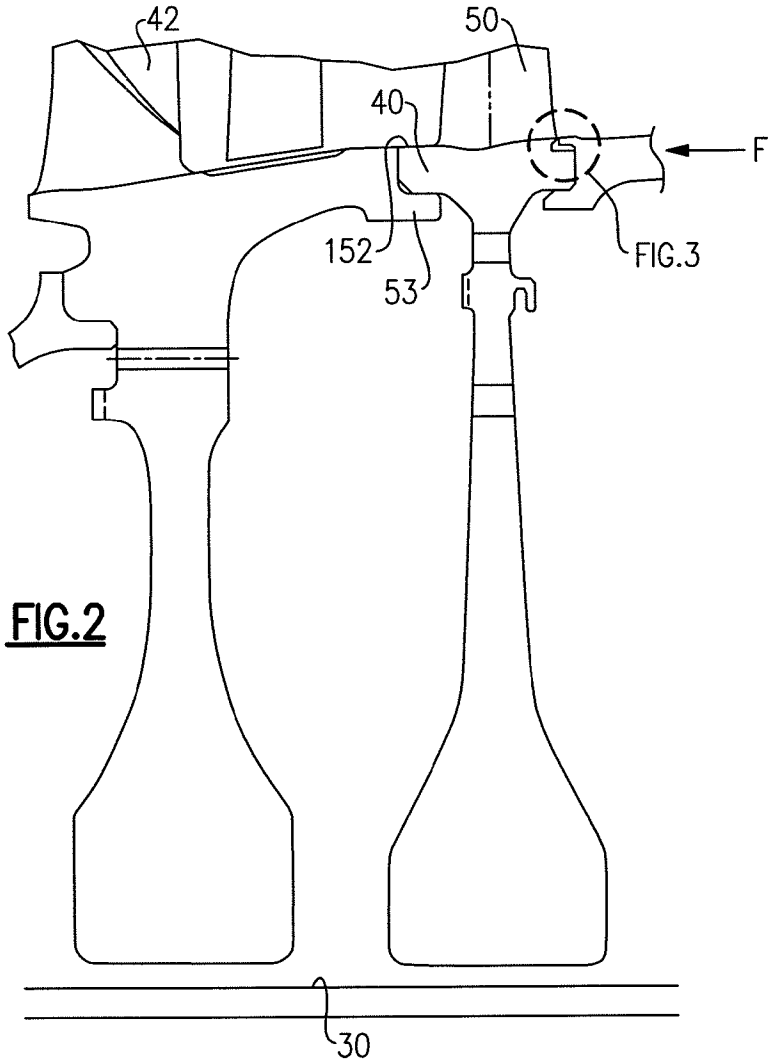
FIG. 2 shows a portion of the FIG. 1 section with an undercut.

As shown in FIGS. 2 and 3, the axial component F is delivered from the downstream stage 44 into the integrally bladed rotor stage 40. The integrally bladed rotor stage 40 has an upstream ear 152 fitting within a recess 53 on the next most upstream rotor section 42. The rotor stage 44 has a pocket 72 having an outer ear 74 and an inner ear 70. A bottom portion 68 of a platform 52 of the rim of the integrally bladed rotor 40 has a forward edge or contacting surface 66 abutting the face of pocket 72. Thus, the force F is passed into the edge 66. A curved undercut 64 is cut away from the rim under the platform 52, such that a trailing edge 62 of the airfoil 50 is not exposed to the force F. The undercut is radially between the platform 52 and forward edge 66, relative to a central axis of the rotor 50. Instead, the undercut 64 limits the upper surface 69 of the rim at the area of the connecting surface faces of edges 66 and pocket 72. The contacting surface 66 extends beyond the platform 52 and the undercut 64 in a downstream direction. This ensures there are no forces transmitted from the force F into the airfoil 50, which is undesirable.

Figure 4:
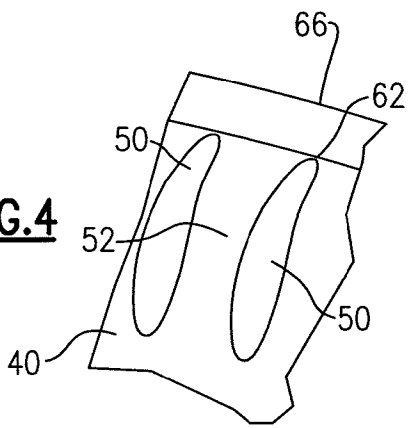
FIG. 4 is a top view of an example rotor incorporated into the present invention.

As can be appreciated from FIG. 4, the rim of the rotor stage 40 receives a plurality of airfoils 50 with trailing edges 62, which is separated from the ear 74 such that the abutting contact is radially inward of the lowermost end of the airfoil 50.

With the disclosed embodiment, the forces are not transmitted into the airfoil, and the undercut ensures that the damage to the airfoil is limited or eliminated due to the force F. In addition, the stresses from the downstream rotor rim are also addressed with this arrangement.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. An integrally bladed rotor for being utilized in a gas turbine engine comprising:

an airfoil extending radially outwardly from a platform, and an undercut between said airfoil and said platform at a downstream edge of said airfoil;

said rotor is to be part of a compressor section in a gas turbine engine with a downstream rotor stage to transmit a force to said integrally bladed rotor;

said undercut is at an end that will be downstream when said rotor section is mounted, and extends back into a body of a rim of said integrally bladed rotor;

a forward contacting surface of said rim extends in a direction that will be downstream when said rotor section is mounted in a gas turbine engine beyond the platform and the undercut to provide a contact surface for receiving a transmitted force from a tie shaft; and wherein said integrally bladed rotor has a central axis, and said undercut is radially intermediate said platform and said forward contacting surface.

2. The rotor as set forth in claim 1, wherein a downstream rotor section provides an abutment face to be positioned in contact with said integrally bladed rotor.

3. A section for use in a gas turbine engine comprising:

a plurality of adjacent stages, each of said stages including a rotor, and a plurality of blades extending from each of said rotors, and said blades having airfoils;

at least one of said rotors having blades with an undercut in an area where said airfoil merges with a platform;

a tie shaft for transmitting a force into said one of said rotors, which is then passed to said adjacent rotors;

said at least one of said rotors having said undercut is an integrally bladed rotor having a plurality of rotor blades extending from a rim;

said undercut is at a downstream end of said airfoil, and then cut back into a body of said rim;

a forward contacting surface of said rim extends in a direction that will be downstream when said section is mounted in a gas turbine engine and beyond said platform and said undercut to provide a contact surface for receiving a transmitted force from the tie shaft; and wherein said integrally bladed rotor has a central axis, and said undercut is radially intermediate said platform and said forward contacting surface.

4. The section as set forth in claim 3, wherein said integrally bladed rotor is part of a compressor section, and a downstream rotor stage transmits a force to said at least one of said rotors having said undercut.

5. The section as set forth in claim 3, wherein a downstream rotor section provides an abutment face to be positioned in contact with said integrally bladed rotor, said downstream rotor section transmitting a force from a tie shaft to said integrally bladed rotor.

6. The section as set forth in claim 5, wherein said downstream rotor section abutment face is radially intermediate a radially inner and radially outer ear, with said forward contacting surface of said hub extending axially beyond said undercut, and said platform, and between said radially inner and outer ears of said downstream rotor to contact said abutment face.

* * * * *